United States Patent [19]

Terasawa et al.

[11] Patent Number: 4,951,066

[45] Date of Patent: Aug. 21, 1990

[54] INK JET RECORDING APPARATUS HAVING A DISCHARGE ORIFICE SURFACE AND A BLADE AND RUBBING MEMBER FOR CLEANING THE SURFACE INDEPENDENTLY OF EACH OTHER

[75] Inventors: Koji Terasawa, Mitaka; Akira Miyakawa, Tanashi; Hideki Yamaguchi, Yokohama; Shinya Matsui, Yokohama; Mikio Shiga, Yokohama; Shigeru Tsuyukubo, Kawasaki; Yoji Ara; Katsuyuki Yokoi, both of Yokohama; Masaaki Nakamura, Toyonaka; Yoshiaki Kaburagi, Tokyo; Takanori Mukai, Chichibu; Shoichiro Shoda, Yokohama; Tetsuo Kimura, Sagamihara, all of Japan

[73] Assignee: Canon Kabushiki Kaisha, Tokyo, Japan

[21] Appl. No.: 263,021

[22] Filed: Oct. 27, 1988

[30] Foreign Application Priority Data

| | | | |
|---|---|---|---|
| Oct. 30, 1987 | [JP] | Japan | 62-275034 |
| Oct. 30, 1987 | [JP] | Japan | 62-275035 |
| Nov. 5, 1987 | [JP] | Japan | 62-278175 |
| Oct. 7, 1988 | [JP] | Japan | 63-253458 |

[51] Int. Cl.[5] ..... B41J 2/165

[52] U.S. Cl. ..... 346/140 R; 346/1.1

[58] Field of Search ..... 346/140, 1.1

[56] References Cited

U.S. PATENT DOCUMENTS

| | | | |
|---|---|---|---|
| 4,045,802 | 8/1977 | Fukazawa et al. | 346/140 R |
| 4,112,435 | 9/1978 | Kattner et al. | 346/140 R |
| 4,144,537 | 3/1979 | Kimora | 346/140 |
| 4,306,245 | 12/1981 | Kasugayama et al. | 346/140 R |
| 4,364,065 | 12/1982 | Yamamori et al. | 346/140 R |
| 4,401,990 | 8/1983 | Aiba et al. | 346/75 |
| 4,436,439 | 3/1984 | Koto | 346/140 X |
| 4,450,456 | 5/1984 | Jekel | 346/140 |
| 4,479,136 | 10/1984 | Lewis | 346/140 |
| 4,543,589 | 9/1985 | Terasawa | 346/140 R |
| 4,556,894 | 12/1985 | Terasawa | 346/140 |
| 4,589,000 | 5/1986 | Koto et al. | 346/140 R |
| 4,600,931 | 7/1986 | Terasawa | 346/140 R |
| 4,692,777 | 9/1987 | Hasumi | 346/140 |
| 4,745,414 | 5/1988 | Okamura et al. | 346/140 R |
| 4,774,523 | 9/1988 | Beaufort | 346/25 |

FOREIGN PATENT DOCUMENTS

| | | |
|---|---|---|
| 94472 | 6/1983 | Japan . |
| 83664 | 5/1984 | Japan . |

*Primary Examiner*—Joseph W. Hartary

*Attorney, Agent, or Firm*—Fitzpatrick, Cella, Harper & Scinto

[57] ABSTRACT

A method of cleaning a discharge port surface of an ink jet recording apparatus includes wiping the surface using a blade having a certain contact area with the surface and rubbing the surface using a rubbing member having a larger contact area with the surface than the blade. The wiping and rubbing operations are performed independently of each other so that their different purposes can be better accomplished. For example, since rubbing the surface need not be done as often as wiping, they can both be performed at optimum intervals. The rubbing member can be removably mounted to a replacement ink cartridge so that the rubbing member can be conveniently replaced at the same time as the cartridge.

32 Claims, 23 Drawing Sheets

INK JET RECORDING APPARATUS HAVING A DISCHARGE ORIFICE SURFACE AND A BLADE AND RUBBING MEMBER FOR CLEANING THE SURFACE INDEPENDENTLY OF EACH OTHER

BACKGROUND OF THE INVENTION

1. Field of thc Invention

This invention relates to an ink discharge recording device in an ink jet recording apparatus, and in particular to an ink discharge recovery device provided with cleaning means for cleaning the discharge port surface of a recording head.

2. Related Background Art

With an ink jet recording apparatus, it has sometimes been the case that in addition to the entry of air into a recording head and the adherence of paper powder and dust or viscosity-increased ink to the surroundings of the orifice of that as in the recording head (the vicinity of an opening for discharging ink therethrough), unsatisfactory discharge such as non-discharge of the ink or the deviation of the direction of discharge is caused by the collection of ink around the orifice.

So, solutions such as the provision of means for removing the foreign materials which cause the unsatisfactory discharge have been adopted.

In an ink jet recording apparatus, as means for preventing the ink discharge ports from clogging due to the increase in viscosity of ink caused by evaporation of the ink solvent, the adherence of dust or the creation of bubbles, there is a construction as described, for example, in U.S. Pat. No. 4,045,802 and U.S. Pat. No. 4,603,931, wherein the ink discharge port surface of the recording head is covered with a cap to thereby shield the ink discharge port surface from the atmosphere and keep the discharge ports in a good condition, and a construction in which a discharge recovery device for causing ink to be discharged by a suction pump or the like is provided.

Such a capping operation and such a discharge recovery operation are usually effected when a carriage is at its home position.

Also, for removing ink and dust present near the discharge port, there is a construction as described in U.S. Pat. No. 4,112,435, U.S. Pat. No. 4,364,065 and Japanese Laid-Open Pat. Application No. 58-94472 wherein as cleaning means, a flexible blade formed of rubber or like material is used to wipe the front face of the recording head (the surroundings of the discharge ports) (this will hereinafter be referred to as prior art ①). As the cleaning means, besides the above-mentioned one, there is a construction as described, for example, in U.S. Pat. No. 4,306,245 wherein a brush and an ink absorbing member slide across around the discharge ports (this will hereinafter be referred to as prior art ②. Further, there is a construction as described in Japanese Laid-Open Pat. Application No. 59-83664 wherein the surroundings of the discharge ports are first wetted by sponge impregnated with water and then are wiped by a blade (this will hereinafter be referred to as prior art ③).

However, it has been found from numerous experiments that in the above-described prior art, ① -③, recovery from unsatisfactory ink discharge is not fully accomplished in some cases and there is the necessity of improvement.

In the case of prior art ①, liquid drops of relatively low viscosity such as ink drops adhering to the surroundings of the discharge ports and dewdrops formed on the surroundings of the discharge ports by the rise of the humidity in the apparatus can be removed by the discharge recovery operation using suction or the like. However, when an attempt is made to resume recording after recording has been ceased or stopped for a long time, the occurrence of non-discharge is eliminated by the discharge recovery device, but the direction of flight of ink deviates and thus, it has become impossible to cause ink droplets to adhere to a accurate positions on the surface of a recording medium and images formed thereon have sometimes been disturbed.

In the case of prior art ②, cleaning is repetitively effected at the home position and therefore, the stain or fluffing of the surface of the absorbing member attributable to the durability of the absorbing member causes foreign materials to adhere to the surroundings of the discharge ports, and this has sometimes resulted in unsatisfactory ink discharge.

In the case of prior art ③, the sponge retains water content therein and therefore, the rise of the humidity in the apparatus is expedited and the total amount of water drops adhering to the surroundings of the discharge ports due to dew formation is increased, and this has increased the wiping operation by the blade and thus, this could not be a radical improvement.

So, recording tests have been carried out under all conditions while observing the surroundings of the discharge ports of the recording head and the causes of unsatisfactory ink discharge have been thoroughly investigated.

As a result, it has been found that unsatisfactory discharge is attributable to the fact that the state of the ink adhering to the surroundings of the discharge ports OF changes as shown in FIGS. 1A -1D of the accompanying drawings. If, as shown in FIG. 1A and 1B, ink adheres as drops ID to the surroundings of the discharge ports OF, like dew, and is dried up, the ink assumes a state of very thin film ID' on the surroundings of the discharge ports OF as shown in FIGS. 1C and 1D.

Such an ink film 1D' has often been created when non-recording has lasted long. Heretofore, it has been known that unsatisfactory discharge occurs when recording is resumed after a long downtime of recording, but the cause thereof has been regarded as being attributable to an increase in the viscosity of ink or entry of air into ink. Certainly, most of the causes of non-discharge are the clogging resulting from an increase in the viscosity of ink and entry of air, but nobody has been aware that the cause of the deviation of the direction of ink discharge is attributable to the film of ink as noted above. Further, such a film has reduced the ink-repellent property of the discharge port surface and has induced a state in which ink is ready to such surface.

In view of the above-noted fact, it has been studied, through numerous repetitive experiments what is the construction of an ink jet recording apparatus in which the causes of unsatisfactory discharge can be eliminated most effectively and good recorded images can be obtained.

As a result, it has been found that as the cleaning means for the discharge port (orifice) surface of the ink jet recording apparatus, it is still preferable from the viewpoints of the effect of wiping and the problem of the durability of the cleaning means to remove ink drops, pools of ink and formed dew on the discharge port (orifice) portion by the aforementioned flexible blade. In an apparatus provided with a heating and fixating heater for expediting the fixation of ink, particularly, the ink adhering as a recorded image to the recording medium, the probability with which dew is formed by the evaporation of the water content of the ink becomes high and the role of the blade is very great. However, if ink drops or pools of ink adhere to the surroundings of the discharge ports for a long time and form very thin film or the like on the surroundings of the discharge ports, the direction of discharge is made unstable by the film even if pools of ink are apparently eliminated, and in addition, the ink-repellent property of the discharge port surface is reduced and pools of ink become ready to be created and thus, discharge misdirection becomes ready to occur. Such ink film could not be fully removed by the cleaning by the blade a previously described.

SUMMARY OF THE INVENTION

The present invention has been made in view of the above-noted problems. It is an object of the present invention to provide an ink jet recording apparatus in which ink drops, water drops, dust, etc. adhering to the vicinity of discharge ports can be removed and a film caused by the ink adhering thereto can also be removed.

It is another object of the present invention to provide an ink jet recording apparatus in which unsatisfactory ink discharge can be prevented from occurring due to deterioration of a member for cleaning discharge ports.

It is still another object of the present invention to provide an ink jet recording apparatus in which optimum cleaning can be effected in conformity with the state of foreign materials adhering to the vicinity of discharge ports to thereby prevent unsatisfactory discharge.

It is yet still another object of the present invention to provide an ink jet recording apparatus in which the effect of removing a film by a rubbing member can be maintained.

It is a further object of the present invention to provide a method of cleaning the vicinity of the discharge ports of an ink jet recording apparatus, characterized in that cleaning comprising wiping the vicinity of said discharge ports by a blade with a certain contact surface with respect to the vicinity of said discharge ports and cleaning comprising rubbing the vicinity of said discharge ports by rubbing means with a contact surface larger than said contact surface are effected independently of each other.

It is still a further object of the present invention to provide an ink jet recording apparatus in which cleaning conforming to the state of ink can be accomplished by said method to thereby prevent unsatisfactory ink discharge.

It is yet still a further object of the present invention to provide an ink jet recording apparatus having a recording head having discharge ports for discharging ink therethrough, blade means for wiping the vicinity of said discharge ports with a certain contact surface with respect to the vicinity of said discharge ports, rubbing means for rubbing the vicinity of said discharge ports with a contact surface larger than said contact surface, and control means for driving the wiping operation by said blade means and the rubbing operation by said rubbing means independently of each other.

It is another object of the present invention to provide an ink jet recording apparatus having a carriage for scanning a recording head having discharge ports for discharging ink therethrough relative to a recording medium, and heating means for heating said recording medium, characterized by blade means provided outside the recording area for wiping the vicinity of said discharge ports on the basis of a predetermined sequence during the recording operation, rubbing means differing from said blade means and provided at a position outside the recording area whereat it can contact with said recording head, and means for moving said carriage to the vicinity of a position at which it can contact with said rubbing means, said means producing a command for cleaning the vicinity of said discharge ports by said rubbing means when a predetermined signal is input to said means.

It is still another object of the present invention to provide an ink cartridge removably mounted with respect to an ink jet recording apparatus having a cleaning member for cleaning the vicinity of discharge ports for discharging the ink of a recording head therethrough, and containing ink to be supplied to said head, characterized by means for connecting said cleaning member and said cartridge together.

It is yet still another object of the present invention to provide an ink jet recording apparatus provided an ink jet recording apparatus provided with an ink cartridge in which an interchangeable member such as a cleaning member is connected by said construction, whereby the maintenance work is simplified. construction, whereby the maintenance work is simplified.

It is another object of the present invention to provide an ink jet recording apparatus which enables the user to readily know the period of interchange of a cleaning member.

DESCRIPTION OF THE PREFERRED EMBODIMENTS

The present invention will hereinafter be described specifically with reference to the drawings, but the present invention is not restricted to embodiments which will hereinafter be described.

That is, the present invention may be of any construction which can achieve the objects of the invention, and may of course permit combinations of constituents in the embodiments which will hereinafter be described, the timing of the cleaning operation and the sequence, as well as any construction which effects sequence control comprising a combination of further constituents.

[First Embodiment]

Figure 1A:
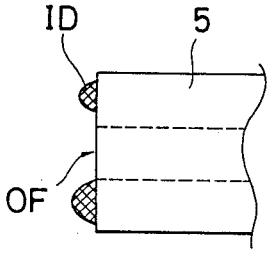
FIG. 1A –1D are schematic views showing the state of the discharge port surface of a recording head.
Figure 1B:
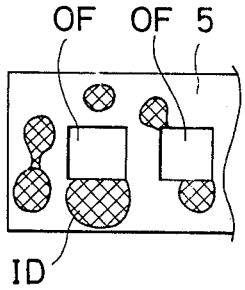
Figure 1C:
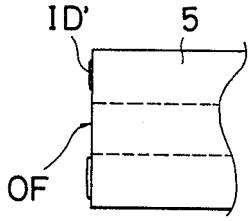
Figure 1D:
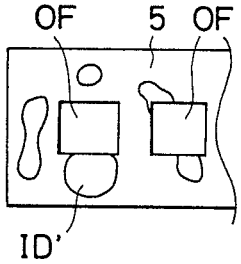
Figure 2A:
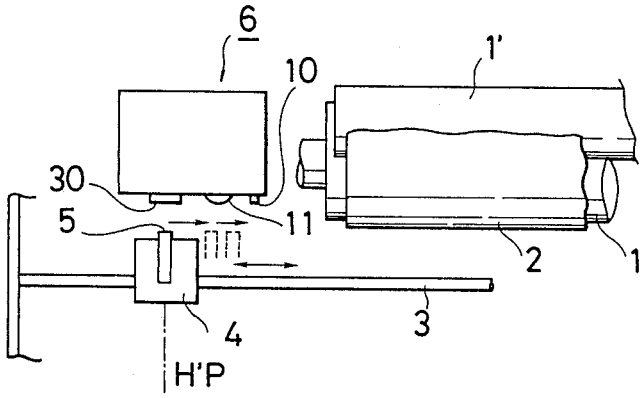
FIGS. 2A –2C are a schematic plan view, a schematic perspective view and a schematic perspective view, respectively, showing the essential portions of an ink jet recording apparatus according to the present invention.
Figure 2B:
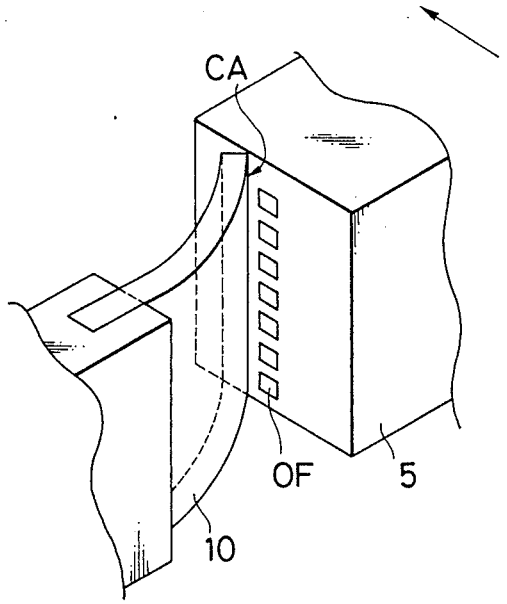
Figure 2C:
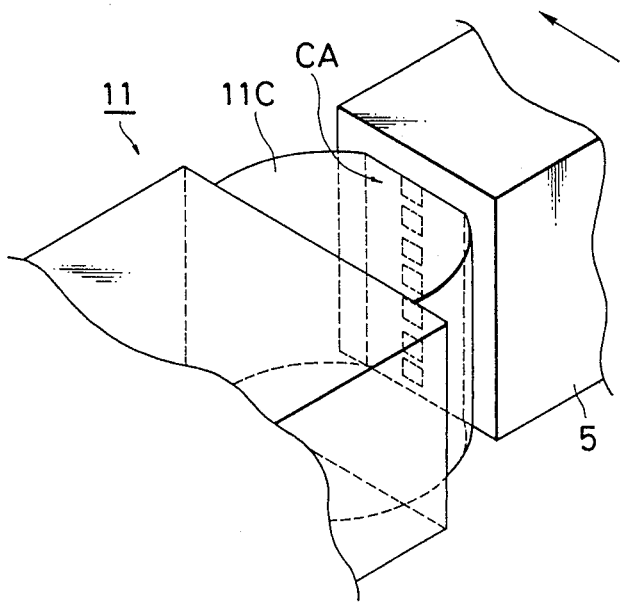

FIGS. 2A –2C are a schematic plan view, a schematic perspective view and a schematic perspective view, respectively, showing the essential portions of an ink jet recording apparatus according to the present invention.

Referring to FIG. 2A, a guide shaft 3 is installed forwardly of paper 2 as a recording medium backed up by a platen 1, and an ink jet recording head 5 is carried on a carriage 4 movable along the guide shaft 3. Heating means 1' such as a fixating heater is provided on a discharge route for the paper 2 after recording. An electrothermal converting member, not shown, as energy generating means for generating energy utilized to discharge ink is provided in the recording head 5, and by causing heat energy to act on the ink, the ink is discharged. Such a recording head is preferably used for its numerous merits, but may be one using a piezo element or the like. Also, the recording head may be of a construction integrally having an ink tank for containing ink therein, or may be a full line type head in which a number of discharge ports are disposed widthwisely of the recording medium. The discharge port surface of the above-described recording head is subjected, for example, to ink-repellent surface treatment.

A discharge recovery device 6 (of the pump suction type in the illustrated embodiment) for the recording head 5 is provided at the home position HP of the carriage 4. This discharge recovery device is provided with capping means 7 having a cap 30 driven forward and backward relative to the recording head 5 and covering the front face (the orifice portion) of the recording head at the forwardly moved position thereof, and a pump for sucking the ink from the orifices (the ink discharge ports) through the capping means 7. The operation of this recovery device is effected by the input or the like of a key switch, not shown.

A flexible blade 10 for wiping the vicinity of the discharge ports (for example, the discharge port surface) of the recording head 5 is mounted on a side of the discharge recovery device 6.

In the present invention, the blade refers to a member which makes substantially line contact with the discharge port surface, that is, whose area of contact CA is small (see FIG. 2B), and rubbing means refers to a means whose area of contact CA is great (see FIG. 2C).

A rubbing mechanism 11 movable forward and backward with the capping means 7 is provided on a side of the capping means 7.

This rubbing mechanism 11 is means for rubbing the vicinity of the discharge ports (for example, the discharge port surface) of the recording head 5, and has a greater area of contact with the discharge port surface than the aforementioned blade. When the recording head 5 has come off the home position HP by the drive control of the carriage 4 and has come to a position indicated by a dot-and-dash line in FIG. 2, the rubbing member is driven forward with the capping means 7 to bear against the orifice portion and the carriage 4 is moved by a predetermined distance, whereby the orifice surface is rubbed by the rubbing member.

Thus, the rubbing operation of the rubbing mechanism 11 may be accomplished by the cap operation and the carriage operation.

Figure 3:
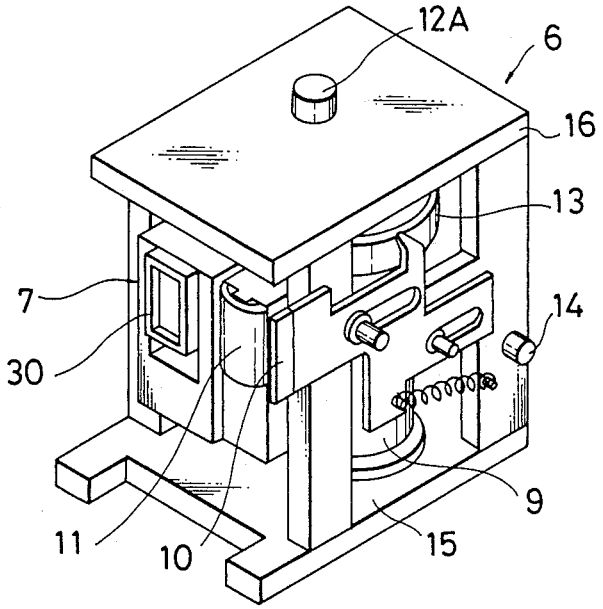
FIG. 3 is a schematic perspective view of an ink discharge recovery device in FIG. 2.
Figure 4:
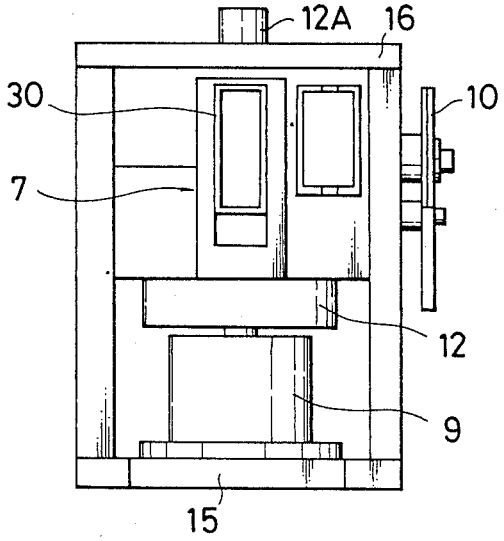
FIG. 4 is a schematic front view corresponding to FIG. 3.
Figure 5:
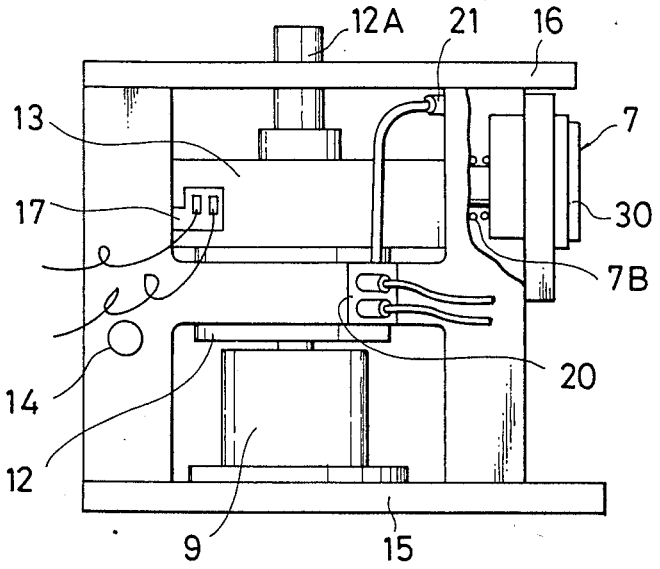
FIG. 5 is a schematic side view corresponding to FIG. 3.
Figure 6:
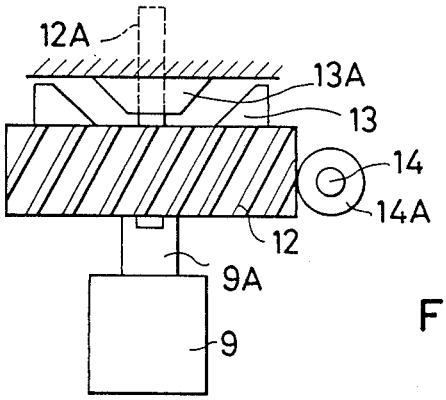
FIG. 6 is a schematic fragmentary enlarged elevational view of a worm wheel cam in FIG. 3.

FIG. 3 is a schematic perspective view of the discharge recovery device 6, FIG. 4 is a schematic front view corresponding to FIG. 3, FIG. 5 is a schematic side view corresponding to FIG. 3, and FIG. 6 is a schematic elevational view of a worm wheel portion forming the drive mechanism in FIG. 3.

Referring to FIGS. 3–6, a pump 9 is mounted on a frame 15, and a worm wheel 12 rides on the piston 9A (FIG. 6) of the pump 9, and a worm wheel shaft 12A integral with the worm wheel 12 is supported by a lid 16.

When a worm 14A (FIG. 6) integral with a worm wheel 14 is rotatively driven, the worm wheel 12 which is in meshing engagement with the worm 14A is rotated.

In this case, the worm wheel 12 is formed with a worm wheel cam 13, and when the worm wheel 12 is rotated, the worm wheel cam 13 comes into abutment against a fixed cam 13A (FIG. 6), whereby the worm wheel 12 is moved downward and the piston 9A of the pump 9 is depressed.

The pump 9 is driven by the depression of this piston 9A and generates a negative suction force lower than the atmospheric pressure.

The return of the piston 9A (the discontinuance of the operation of the pump 9) is accomplished by a spring (a return spring), not shown, in the pump 9.

The forward and backward movement of the capping means 7 with respect to the recording head 5 is accomplished by the engagement between the inner surface cam (another cam surface, not shown) of the worm wheel cam 13 and the capping means.

As previously described, the cap 30 formed, for example, of silicone, butyl chloride or the like adapted to be sealingly urged against the orifice surface is provided on the front face of the capping means.

The blade 10 is controlled by a combination of the forward and reverse rotation of the cam 13, a blade stop lever and the carriage operation so that it is moved forward by a predetermined amount when the capping means 7 is brought into its opened condition by rotation of the cam 13. Alternatively, the blade 10 may be fixed at its forwardly moved position.

Figure 7:
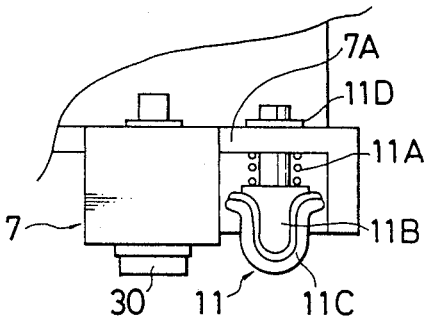
FIG. 7 is a schematic fragmentary enlarged plan view of a rubbing mechanism in FIG. 3.

FIG. 7 is a partial plan view showing the assembled state of the rubbing mechanism 11.

Referring to FIG. 7, the rubbing mechanism 11 comprises a block 11B supported on a base member 7A integral with the capping means 7 for movement back and forth, and a rubbing member 11C attached to the block 11B with a plate-like porous material interposed in a U-shape therebetween, said rubbing member 11C being assembled in such a manner that the current surface portion thereof is protruded by a predetermined amount toward the recording head side by a compression spring 11A mounted between the block 11B and the base member 7A.

The anti-slippage of the block 11B from the base member 7A is accomplished by a snap ring 11D.

The material forming the rubbing member 11C may preferably be a porous material, and more preferably be a material having more or less soft texture and a water-absorbing property, such as urethane, polyvinyl alcohol (PVA), polyethylene (PE), polyvinyl formal, polypropylene or polyurethane, and unwoven fabric or the like is also usable as the rubbing member.

Figure 8:
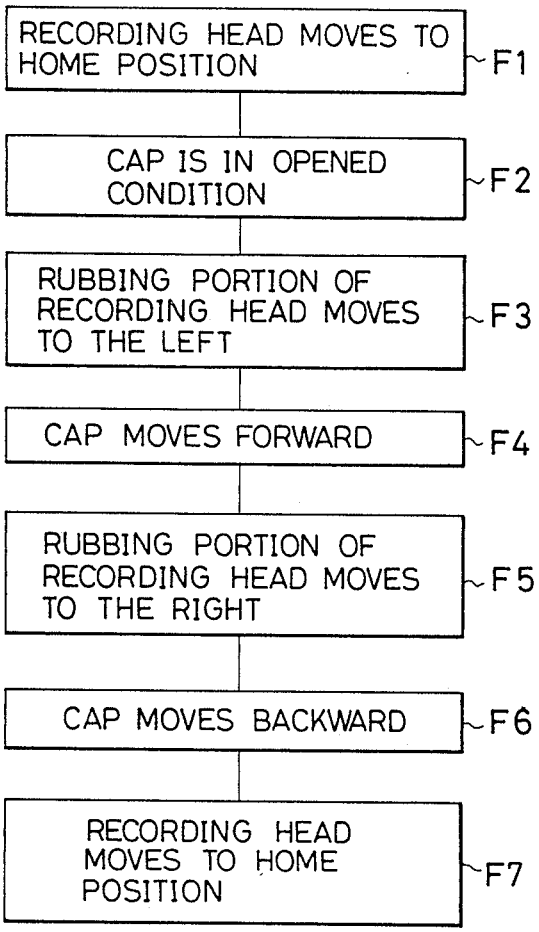
FIG. 8 is a flow chart showing the operation procedure of the rubbing mechanism of an ink jet recording apparatus according to the present invention.

FIG. 8 is a flow chart of the operation procedure when the rubbing operation of the orifice portion of the recording head 5 is effected by the above-described rubbing mechanism 11.

In FIG. 8, at step F1, the recording head 5 is first moved to the home position HP, and the capping means 7 is kept as it is or is once closed, whereafter it is opened (step F2).

Next, at step F3, the carriage 4 is moved to the right as viewed in FIG. 2 by a predetermined amount with the capping means 7 opened, and is set in a position wherein the rubbing member 11C can bear against the orifice portion of the recording head 5.

Then, at step F4, the capping means 7 is moved forward to a point corresponding to the closed position and the rubbing member 11C of a porous material is urged against the orifice portion by the spring 11A.

Then, at step F5, the carriage 4 is further moved to the right as viewed in FIG. 2 with the rubbing member 11C urged against the orifice portion, and the rubbing member 11C slides while rubbing the orifice surface. Thereby, very thin adhering films or the like produced by the desiccation of pools of ink on the orifice surface are removed.

By the film of ink being thus removed, the wetting property of the orifice surface can be maintained constant and stable ink discharge can be realized.

After the orifice surface has been rubbed, at step F6, the capping means 7 is moved backward, and at step F7, the recording head 5 is returned to the home position HP.

Also, the ink discharge recovery device 6 has various recovering functions.

That is, the discharge recovery device has various recovering functions such as the discharge recovery for effecting the charge of ink into the ink supply system, the recording head 5 and a subtank provided between the recording head and a main tank containing the ink therein and the discharge of ink increased in viscosity and bubbles, and the recovery for dissolving the ink increased in viscosity and solidified ink by a three-way valve mechanism 20 (FIG. 5) for directing the ink from the sub-tank in the ink supply system to the cap and a vent mechanism 21 (FIG. 5).

By suitably combining these various recovering functions, the cleaning by the blade and the cleaning by the rubbing means, a control system is constructed so that always stable ink discharge can be easily and reliably obtained correspondingly to various conditions of use.

The recovery operation including the abovedescribed rubbing operation will hereinafter be described in detail.

Figure 9:
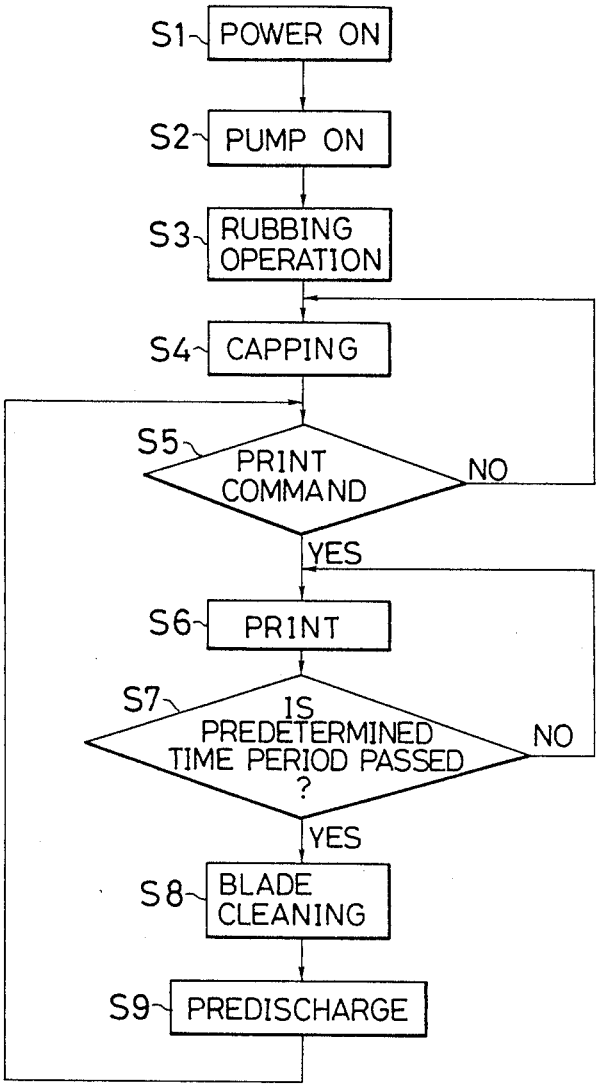
FIG. 9 is a flow chart showing a series of operation procedures of the cleaning operation according to the present invention.

FIG. 9 is a flow chart showing the sequence control operation of the recovery operation. When at step S1, the power switch of the ink jet recording apparatus is closed, the pump 9 is driven and the ink is sucked from the discharge port through the cap 30 and the elimination of the clogging of the discharge ports, the discharge of bubbles, etc. are effected (step S2). Next, at step S3, capping is released and the above-described rubbing operation is performed, whereafter capping is again effected at the home position and the apparatus becomes ready for the recording operation (step S4). When at step S5, a print command comes upon inputting of a recording signal, capping is released and recording is effected (step S6). When a predetermined time (e.g., 10 to 20 sec.) passes after recording has been started (step S7), recording is interrupted and the recording head is moved toward the home position. At this time, the blade 10 is moved forward toward the discharge port surface of the recording head 5. The recording head 5 is moved from the recording area side to the home position side relative to the blade 10 thus moved forward, whereby the recording head is wiped (step S8). Thereafter, at the home position, predischarge of the ink in the cap 30 is effected (step S9), and the recording head 5 continues to be moved to the recording area, thus resuming recording.

In the ink jet recording apparatus, during the recording operation, the internal humidity rises due to the discharged ink and the heating of the recording medium by the heater for fixation, and ink drops and water drops resulting from dew formation are liable to adhere to the discharge port surface, and it is desirable to clean the discharge port surface by the blade at predetermined time intervals. However, it is difficult for the ink film caused by the desiccation of the discharge port surface to be produced during the recording operation. This occurs chiefly during a long downtime of recording.

Accordingly, the cleaning of the discharge port surface by the rubbing means is effected on the basis of a predetermined input signal independently of the cleaning by the blade. That is, the cleaning by the rubbing means is effected only after a long downtime of recording such as the time of power-ON, whereby deterioration of the rubbing means is prevented and efficient release of unsatisfactory discharge conforming to the objects to be removed (ink drops and ink film) can be accomplished.

As regards the timing of the cleaning by the rubbing means, for example, the aforedescribed rubbing function for the orifice surface of the recording head 5 may be omitted in the automatic recovery during the power-ON, and various control sequences may also be designed so that as by effecting the cleaning by the rubbing means during the recovery operation in conformity with a signal produced by the depression of a key switch for effecting a recovery operation differing from the ordinary recovery during the unpacking of the recording apparatus or after a long downtime of the apparatus, the function of the rubbing means is kept good and the time for the recovery operation is made necessary minimum and the amount of ink consumed is minimized.

Further, the rubbing mechanism 11 is of a structure supported by a spring and having back-lash relative to the capping means 7, and is designed such that when it bears against the recording head 5, it is moved backward by spring displacement and the bearing surface thereof becomes proper.

The control or the like of the recovery mechanism such as the capping means 7 and the suction pump 9 and of the cleaning means is executed by detecting the position of the cam (the worm wheel cam) 13 by the contact 17 (FIG. 5) of a limit switch or the like, setting the driving pulse and controlling the angle of rotation of the cam 13. The aforedescribed rubbing operation for the orifice portion is a part of the recovery sequence, and various combinations are possible such as effecting the rubbing operation after predischarge is effected from the recording head 5 to the rubbing member (porous material) 11C and effecting the rubbing operation before or after the sucking operation by the pump 9.

Also, in the illustrated embodiment, the rubbing means 11 is operatively associated with the capping means 7, but alternatively, these may be individually controlled without being operatively associated with each other.

Further, the present invention is not restricted to a serial type recording apparatus in which the recording head 5 is reciprocally moved to the left and right by the carriage 4, but may also be applied to a line print type recording apparatus.

[Second Embodiment]

Figure 10:
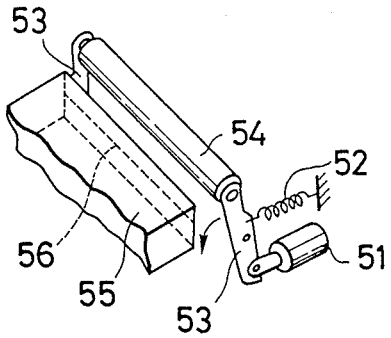
FIGS. 10 and 11 are schematic perspective views showing the essential portions of a rubbing mechanism for the orifice surface of a line print type recording apparatus.

FIG. 10 is a schematic perspective view showing the essential portions of a rubbing mechanism for the line head of a line print type ink jet recording apparatus.

More particularly, FIG. 10 shows an ink jet recovery device using arms 53 and 53 changed over to back and forth by a drive source 51 such as a solenoid and a return spring 52 and a long rotatable roll type rubbing member (porous material) 54 to rub the front surface of a line head (ink jet head) 55, i.e., the surface in which orifices 56 are arranged.

In the structure of FIG. 10, the porous material 54 is made into a rotatable member and therefore, abrasion can be reduced.

[Third Embodiment]

Figure 11:
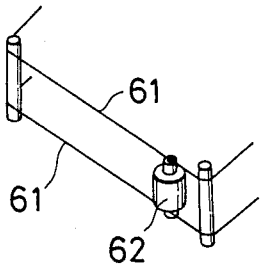

FIG. 11 shows a rubbing mechanism in which a roll type rubbing member (porous material) 62 rotatable about a vertical axis is mounted between two upper and lower wires 61 and 61 and the wires 61 and 61 are driven to the left and right by a motor or the like to thereby slide the rubbing member 62 while the rubbing member 62 bears against the orifice portion in the front surface of the line head (not shown).

[Fourth Embodiment]

Figure 12:
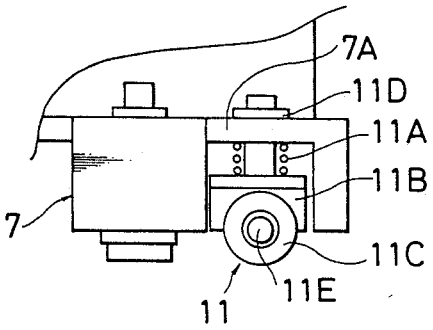
FIG. 12 is a schematic fragmentary enlarged plan view of a fourth embodiment of the rubbing mechanism of FIG. 7.

FIG. 12 is a plan view showing the essential portions of still another embodiment of the present invention.

This embodiment is such that a block shaft 11E perpendicular to a block 11B supported on the base plate 7A of the capping means 7 is provided and a roll-like rotatably rubbing member 11C of porous material is rotatably and interchangeably mounted in such a manner as to be dropped onto the block shaft 11E from above.

The other portions and sequence of the present embodiment are substantially the same as those of the aforedescribed first embodiment.

[Fifth Embodiment]

Figure 13:
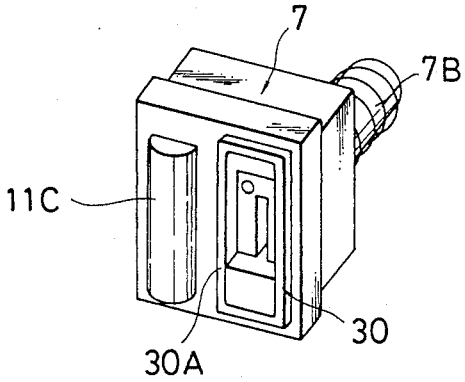
FIG. 13 is a schematic fragmentary perspective view of the rubbing mechanism of the discharge recovery device of an ink jet recording apparatus according to a fifth embodiment of the present invention.

FIG. 13 shows another example of the structure of the rubbing mechanism 11 in which the rubbing member 11C of porous material is formed integrally with the rubber cap 30 fitted to the front face of the capping means 7. A cap clip portion 30A which is in intimate contact with the circumference of the orifice portion of the recording head 5 is formed around the cap portion of the rubber cap 30.

In the example shown in FIG. 13, the rubbing member 11C is formed of a soft porous material protruding in a semi-cylindrical shape sideways of the cap clip portion 30A on the front face of the rubber cap 30, as shown.

According to the rubbing mechanism of FIG. 13, the resiliency of the cap spring 7B (FIGS. 5 and 13) of the capping means 7 and the elasticity of the rubber cap 30 itself can be utilized to cause the rubbing member 11C to bear against the orifice portion with a desired pressure force and therefore, the rubbing member mounting mechanism comprising the spring 11A, the block 11B and the snap ring 11D shown in FIG. 7 can be eliminated to thereby reduce the number of parts of the rubbing mechanism 11 and simplify the structure thereof.

According to the above-described first to fifth embodiments, discretely from the operation of the blade, the mechanism 11 operatively associated with the capping means 7 of the ink discharge recovery device 6 and rubbing the orifice surface of the recording head 5 as a part of a series of recovery sequences is provided and the recovery operation is performed by the utilization of the rubbing operation of the rubbing mechanism 11 and the operation of the carriage and therefore, pools of ink can be removed and an ink film produced by the desiccation or the like of the pools of ink can also be removed easily and reliably by a simple control circuit and a simple drive system, and it has become possible to keep the wetting property of the orifice portion of the recording head constant and realize stable ink discharge.

Also, during the ink recovery operation, the orifice portion of the recording head 5 can be rubbed by the rubbing member (porous material) 11C, 54, 62 and therefore, the wetting property (the ink-repellent property) of the orifice portion can always be easily maintained constant, and it has become possible to eliminate any printing misdirection which makes the landing point of the ink irregular.

Further, the series of recovery sequences are effected with the rubbing operation for the recording head 5 and therefore, special operations are unnecessary.

Figure 14:
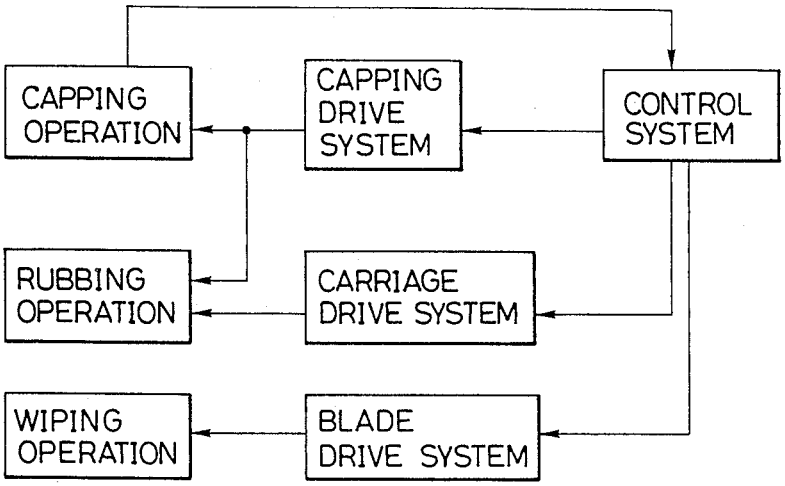
FIG. 14 is a block diagram of an embodiment of the present invention.

FIG. 14 is a block diagram for effecting the rubbing operation.

Figure 15:
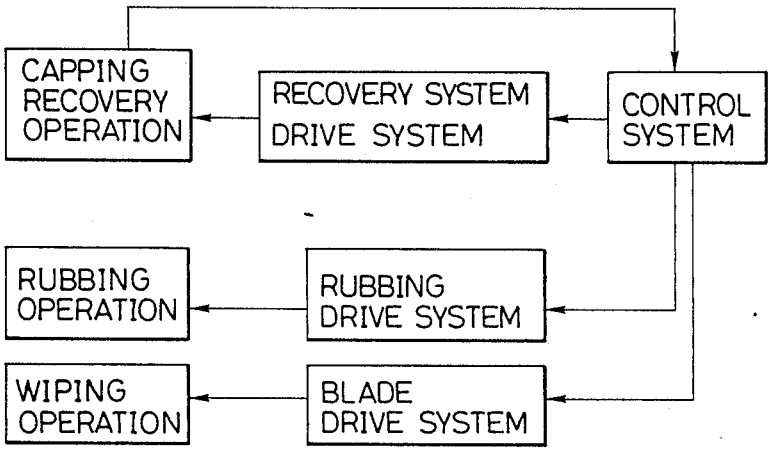
FIG. 15 is a block diagram of another embodiment of the present invention.

Also, discretely from what has been described above, as shown in the block diagram of FIG. 15, the rubbing operation can be accomplished by another drive system without the utilization of the carriage operation.

The present invention can also be carried out by other various suitable sequences than the abovedescribed sequences.

[Sixth Embodiment]

Figure 16:
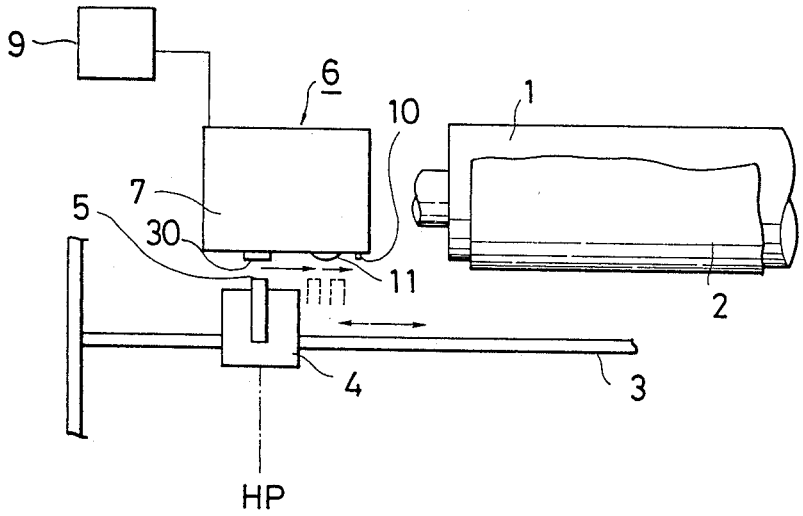
FIG. 16 is a schematic plan view showing the essential portions of an ink jet recording apparatus according to an embodiment of the present invention.

FIG. 16 shows the construction of the essential portions of an ink jet recording apparatus according to a sixth embodiment of the present invention. The basic construction of this embodiment is similar to that of the previously described embodiment, but it will be described again. In FIG. 16, the reference numeral 1 designates a platen forming a recording surface by a cylindrical member, and the reference numeral 2 denotes recording paper wrapped around the platen 1 and having its recording position thereof moved by rotation of the platen 1.

The reference numeral 3 designates a guide shaft, the reference numeral 4 denotes a carriage, and the reference numeral 5 designates a recording head. The carriage 4 is moved along the guide shaft 3 by the drive of a motor, not shown, and with this movement, the recording head 5 carried on the carriage 4 records images on the recording paper 2.

HP indicates the home position of the carriage 4, and at the home position HP, an ink discharge recovery device 6 is disposed in such a manner as to be opposed to the discharge port surface of the recording head 5. The ink discharge recovery device 6 is comprised of capping means 7 movable forward and backward in opposed relationship with the recording head 5 and hermetically sealing the discharge port surface of the recording head 5 in the forwardly moved position thereof, and a pump 9 driven by a discharge recovering operation lever, not shown, and sucking ink from the ink discharge ports through the capping means 7.

On a side, i.e., the right side as viewed in FIG. 16, of the capping means 7, there is provided a flexible blade 10 for wiping the ink discharge port surface of the recording head 5. The reference numeral 11 designates a rubbing mechanism disposed on a portion of the surface of the capping means 7 which is opposed to the recording head 5. The rubbing mechanism moves with forward and backward movement of the capping means 7.

Figure 17:
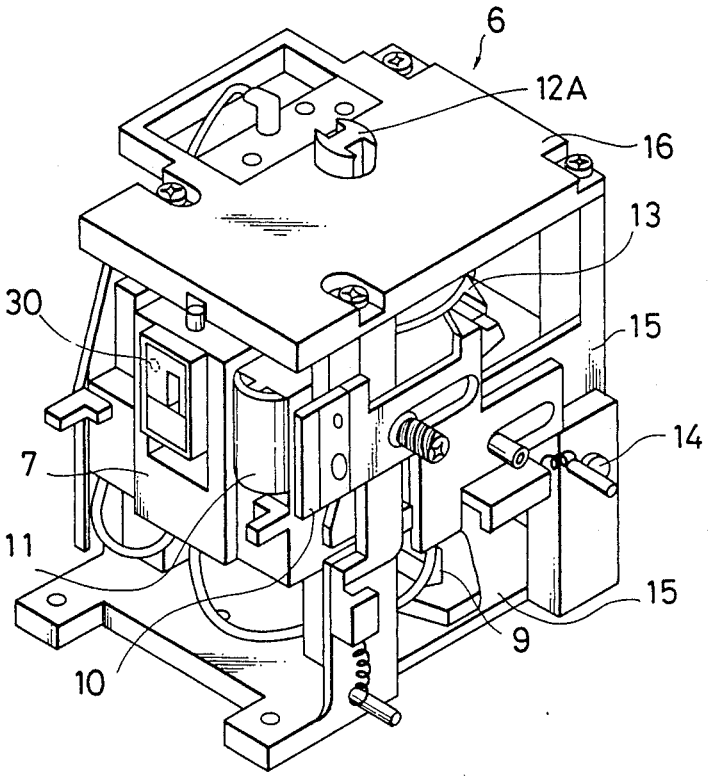
FIGS. 17, 18 and 19 are a schematic perspective view, a schematic front view and a schematic side view, respectively, of an ink discharge recovery device in FIG. 16.
Figure 18:
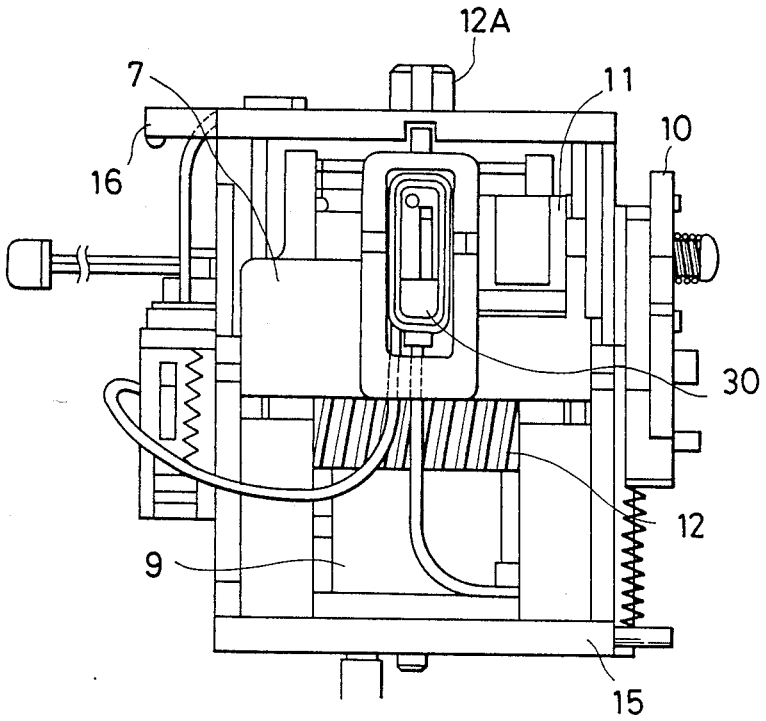
Figure 19:
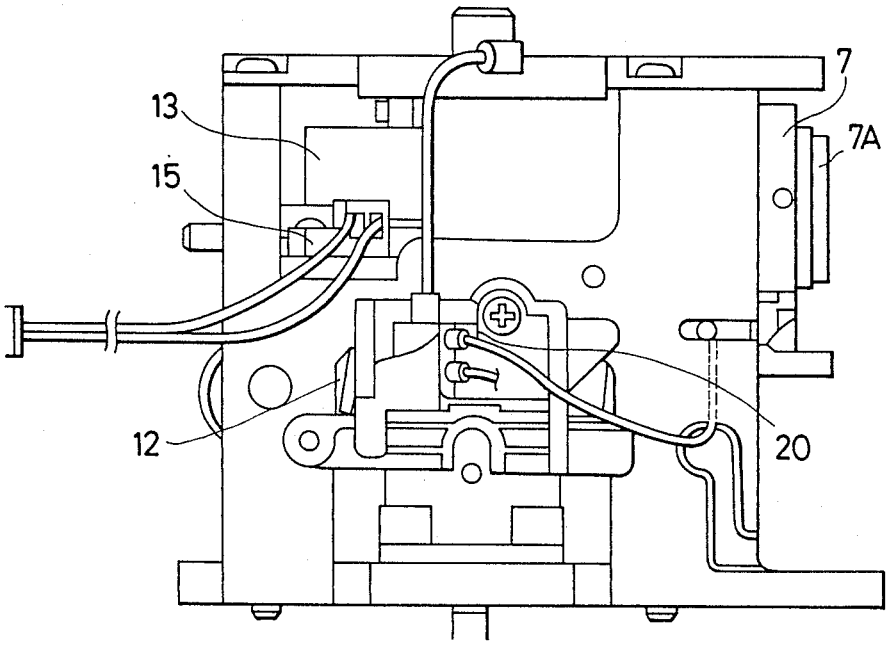
Figure 20:
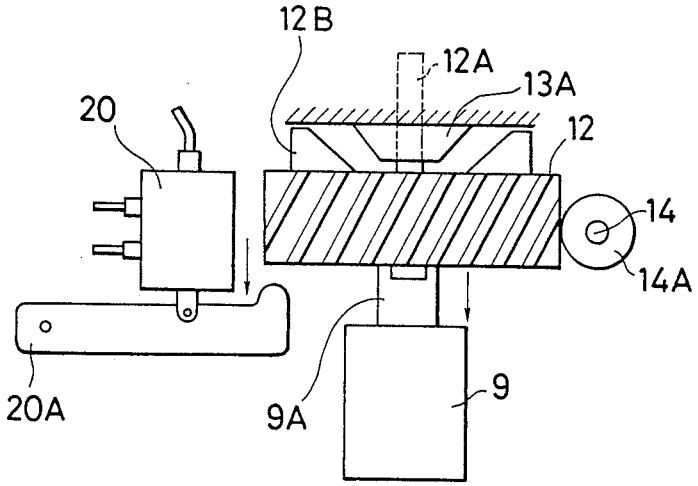
FIG. 20 is a schematic view of a pump driving mechanism in the present invention.

FIGS. 17, 18 and 19 are a schematic perspective view, a schematic front view and a schematic side view, respectively, of the ink discharge recovery device. FIG. 20 is a schematic side view showing the details of a pump driving mechanism in the ink discharge recovery device.

In these figures, the reference numeral 15 designates a frame forming the bottom plate of the ink discharge recovery device 6, the reference character 9A denotes the piston of a pump 9, the reference numeral 12 designates a worm wheel, the reference character 12A denotes a worm wheel shaft, and the reference numeral 16 designates a lid. The pump 9 is mounted on the frame 15, and the piston 9A and the worm wheel 12 are connected together, and the worm wheel shaft 12A is supported on the lid 16 forming a part of the frame 15. The worm wheel 12 and the piston 9A are integral with each other and are vertically movable along the worm wheel shaft 12A, and are biased upwardly by a spring or the like, not shown, in the pump 9.

The reference numeral 13 designates a cam mechanism engaged with the capping means 7, and this cam mechanism 13 is driven by a motor, not shown. Thereby, forward and backward movement of the capping means 7 is accomplished. Also, the blade 10 is driven by the cam of the cam mechanism 13, and by appropriately controlling the rotation thereof, a position opposed to the capping means 7 is defined.

In FIG. 20, the reference numeral 12D designates a worm for transmitting to the worm wheel 12 the drive force transmitted through the worm shaft 14 shown in FIG. 17, thereby rotating the worm wheel 12. The reference character 12B denotes a worm wheel cam mounted on the worm wheel 12, and the reference character 13A designates a fixed cam fixed to the lid 16.

By the engagement between the worm wheel cam 12B and the fixed cam 13A which results from the rotation of the worm wheel 12, the worm wheel 12 is biased and moved downward. Thereby, the piston 9A effects its pressing action in the cylinder of the pump 9 and a communication valve lever 20A is depressed to effect appropriate opening and closing of a communication valve 20. When released from the bias by the worm wheel 12, the communication valve lever 20A restores its original position by the force of a spring or the like, like the piston 9A does. The series of operations of the piston 9A and the communication valve lever 20A, accomplishes the discharge recovery process of sucking the ink increased in viscosity in the nozzle and near the ink discharge ports with the cap opening portion 30 of the capping means 7 shown in FIGS. 17, etc. being brought into intimate contact with the ink discharge port surface.

Figure 21:
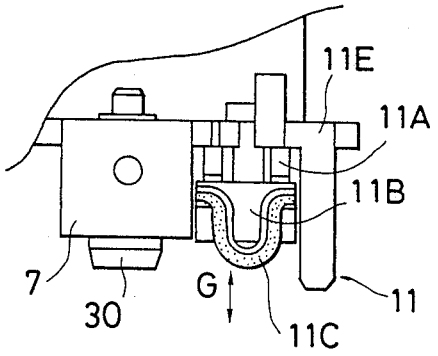
FIG. 21 is a schematic cross-sectional view of a rubbing mechanism portion in the present invention.

FIG. 21 is a top plan view showing the details of the rubbing mechanism. In FIG. 21, the reference character 11B designates a block rotatably mounted on a shaft disposed at a predetermined location in the capping means 7. The reference character 11C denotes a porous member mounted in a U-shape along the block 11B. This porous member 11C, as in the aforedescribed embodiments, may preferably be formed of soft texture comprising a material such as urethane, PVA or PE. The reference character 11E designates a base forming the body of the rubbing means 11, and the reference character 11A denotes a leaf spring attached to the base 11E to bias the block 11B by a predetermined amount.

Figure 22:
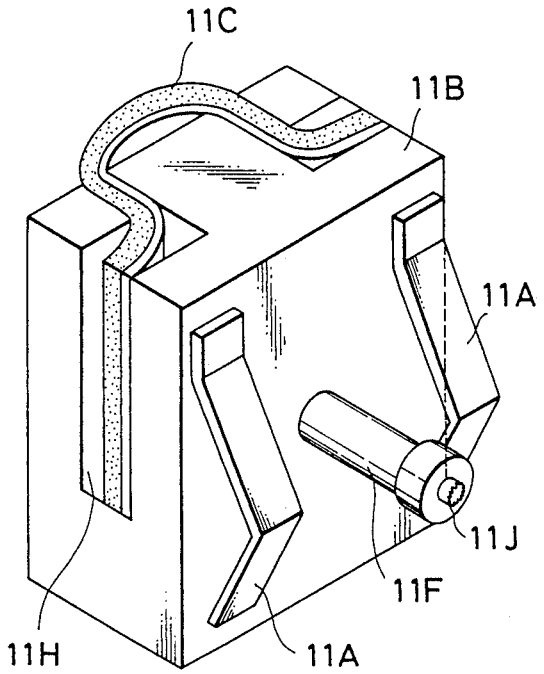
FIG. 22 is a schematic perspective view of the rubbing mechanism portion in the present invention.

FIG. 22 is a perspective view showing the details of a holding member for the porous member 11C. L-shaped grooves 11H are formed at two locations in the block 11B, and the porous member 11C is embedded in a U-shape along these grooves. As a result, the porous member 11C is exposed at a portion of the block 11B, and the discharge port surface of the recording head 5 is rubbed by this exposed portion. Leaf springs 11A are disposed at two locations on that side of the block 11B which is opposite to the side on which the porous member 11C is exposed, and the leaf springs 11A are brought into contact with the base 11E shown in FIG. 21. A dowel 11F is also slidably engaged with a hole formed in the base 11E, and when rubbing the discharge port surface, the block 11B is moved in the direction of arrow G indicated in FIG. 21 while being subjected to the bias of the leaf springs 11A.

Now, among the cleaning members, the life of the porous member 11C of the rubbing means 11 is considerably short as compared with the life of the head and therefore, if it is used beyond its life, the porous surface will become coarse and fluffy and the rubbing effect will become incomplete. So, according to experiments the life of this porous member 11C substantially corresponds to the time during which the ink in the ink cartridge is consumed, and if the porous member 11C is interchanged during the interchange of the ink cartridge, the rubbing effect can always be maintained and it will be possible to prevent printing misdirection or the like and thereby prevent deterioration of the quality of recorded images.

Therefore, as a means for ensuring the user to interchange the porous member 11C during the interchange of the ink cartridge, it has been conceived to make the rubbing mechanism 11 including the porous member 11C integral with the ink cartridge.

Figure 23:
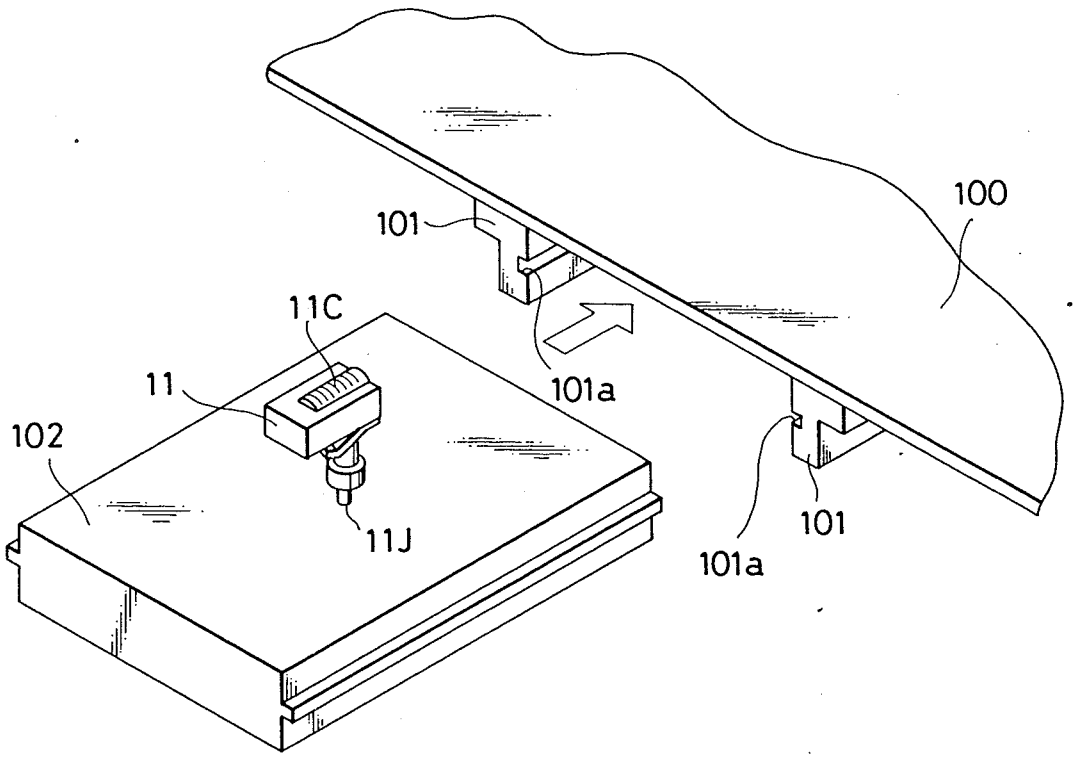
FIG. 23 is a schematic perspective view showing an ink cartridge according to an embodiment of the present invention as it is made integral with the rubbing mechanism portion.

That is, as shown in FIG. 23, ink cartridge holders 101 are attached to the base 100 of the recording apparatus, and guide grooves **101*a* for the ink cartridge 102 are formed in the holders 101. The ink cartridge 102 is pushed in along the guide grooves 101*a*** by a predetermined stroke in the direction of the arrow.

The rubbing mechanism 11 is made integral with the upper portion of the ink cartridge 102 and therefore, the rubbing mechanism 11 will strike against the base 100 of the recording apparatus and the ink cartridge 102 will become uninsertable. So, by breaking the rubbing mechanism 11 at its root portion 11J, the rubbing mechanism 11 and the ink cartridge 102 are separated from each other and here, for the first time, the insertion of the ink cartridge 102 becomes possible. The separated rubbing mechanism 11 is interchanged with the old rubbing mechanism by the user, and the problem of the deteriorated quality of recording caused by forgetting to interchange the rubbing mechanism is solved.

Figure 24:
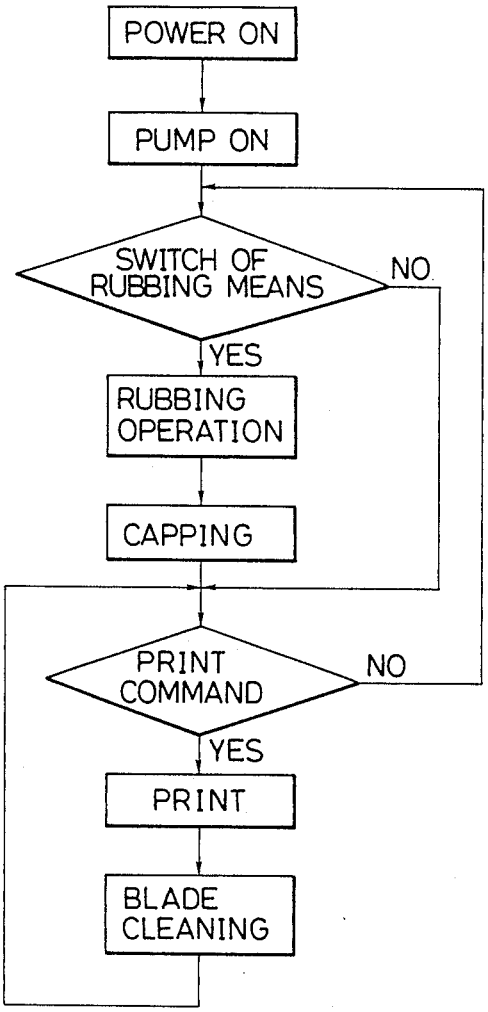
FIG. 24 is a flow chart showing a series of cleaning operation procedures according to the present invention.

The sequence of the recovery operation in the present embodiment will now be described in detail with reference to the flow chart of FIG. 24.

When at step S11, the power switch is closed, the pump is driven and the ink is sucked from the discharge ports (step S12), whereafter the recording standby condition is brought about, but if at this time, at step S13, thereare the input of a switch provided in the apparatus and the inputting of a rubbing means driving signal from a host computer, the rubbing operation is performed as in the aforedescribed first embodiment, and the ink film is removed (step S14).

The recording head is again capped and enters the recording standby condition (step S15). When at step S16, a recording command is given by the inputting of a recording signal, the recording head is reciprocally moved in the recording area and discharges the ink to thereby accomplish recording (step S17). If at this time, recording of a predetermined number of lines is effected, the cleaning by the blade takes place to remove the ink drops or the like on the discharge port surface. The recording of a predetermined number of lines may be printing in one direction effected a plurality of times, or printing in both direction effected a plurality of times. Also, the cleaning switch of the rubbing means may be the same as the witch for effecting the suction recovery (PUMP ON) when the apparatus is in power-ON condition, and the rubbing operation and the suction recovery operation may be effected in association with each other.

[Seventh Embodiment]

Figure 25:
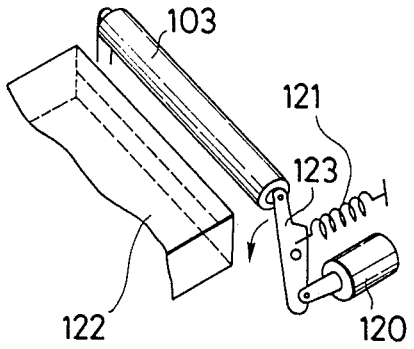
FIG. 25 is a schematic perspective view showing the rubbing mechanism portion in a full line head construction.

FIG. 25 schematically shows the construction of a rubbing mechanism in the case of a line printer, and more particularly shows an example in which a long rotatable porous member 103 corresponding to a recording head is caused to bear against the ink discharge port surface of a line head 122 by the operation of a solenoid 120 and a spring 121. The rotatable porous member 103 is removably mounted relative to a support member 123.

Figure 26:
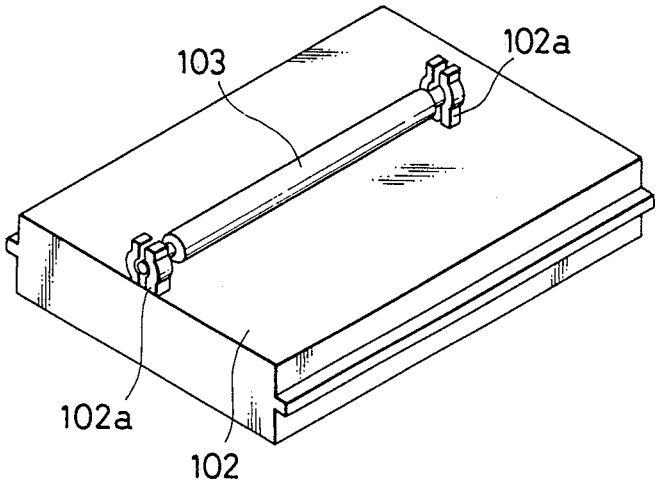
FIG. 26 is a schematic perspective view showing the porous member shown in FIG. 25 as it is made integral with an ink cartridge.

FIG. 26 shows a rotatable porous member 103 which is made integral with an ink cartridge 102 in the case of the construction shown in FIG. 25. This rotatable porous member 103 is removably held by a holding member **102*a* integrally formed on the ink cartridge 102. In this case, the holding member 102*a* remains in a convex shape after the rotatable porous member 103 is pulled out and therefore, a contrivance such as the provision of a groove permitting the escape thereof on the base 100** side of the recording apparatus is necessary.

[Eighth Embodiment]

Figure 27:
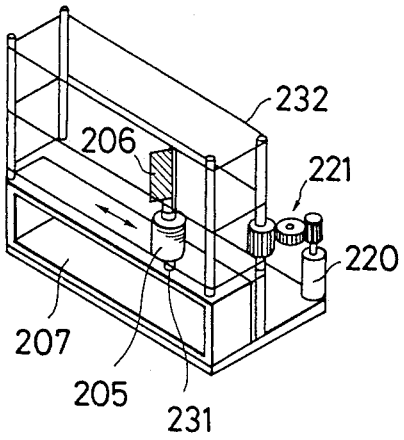
FIGS. 27 and 28 are a schematic perspective view of the rubbing mechanism in the present invention and a schematic view of a full line type ink jet recording apparatus, respectively.

FIG. 27 shows a construction in which a line head 200 as shown in FIG. 25 is scanned by a rotatable porous member 205. In FIG. 27, the porous member 205 is attached to two wires 232 by a fastening means 231, and by driving the wires 232 by a motor 220 and a group of gears 221, the rotatable porous member 205 performs the rubbing operation along the line head 200.

Figure 28:
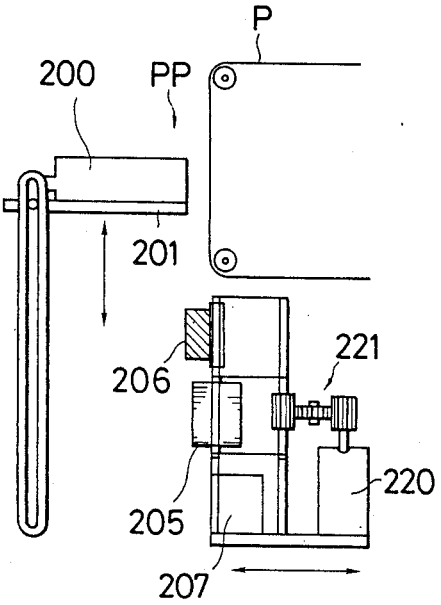

FIG. 28 is a schematic side view showing a full line type ink jet recording apparatus according to the present embodiment.

During the recording operation, as shown, the recording head 200 effects recording while remaining stationary at a position PP (recording position) opposed to a recording medium P. In a case where the recording head 200 effects the printing of a predetermined number of lines or in the case of a cut sheet, a support member 201 carrying the recording head 200 thereon is moved from the recording position to a position opposed to a blade 206 for each page. The recovery device is then moved and the wires 232 are driven to thereby clean the discharge port surface by the blade 206. When recording is to be resumed after a long downtime or the like, the recording head 200 is moved by a rubbing means switch, not shown, from the capping position by a cap 207 to a position at which it can bear against the rotatable porous member 205 as the rubbing means, and the ink film on the discharge port surface is removed by the aforedescribed operation.

A motor 220 for driving the blade 206 and the porous member 205 is common, and by moving the recording head to a position opposed to each of them, cleaning corresponding to each of them is effected.

According to the above-described construction, even in an ink jet recording apparatus using a full line type recording head, the blade, the rubbing means and the cap are arranged in the named order from the recording position, and the interruption time of the recording operation can be shortened and efficient cleaning can be accomplished. (The cap and the rubbing means may be reversed in arrangement.)

[Ninth Embodiment]

Figure 29:
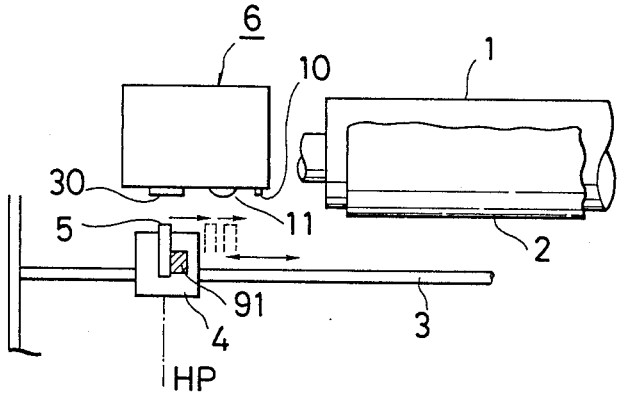
FIG. 29 is a schematic view showing an embodiment of the present invention.

FIG. 29 is a schematic view showing an ink jet recording apparatus according to a ninth embodiment of the present invention.

This embodiment is basically similar in construction to the first embodiment, and the difference between the two embodiments is that the ink film is removed by the rubbing means in conformity with the temperature of the recording head 5 detected by a temperature sensor 91 for detecting the temperature of the recording head.

The ink film is created by desiccation of the ink adhering to the discharge port surface and therefore, as previously described, it is ready to be created when the downtime of recording lasts long. During the downtime of recording, it is sometimes the case that the recording head is pre-heated by heating means or the like, not shown, so that the viscosity of the ink in the discharge ports (in the recording head 5) may not become great. When preheating is so effected during the downtime of recording, it is sometimes the case that although the desiccation of the discharge port is prevented by capping, the ink on the discharge port surface is dried and creates an ink film. In order to prevent this, in the present embodiment, when the temperature of the recording head is above a predetermined level and recording is not being effected, the discharge port surface is cleaned by the rubbing means to thereby remove the ink film.

Figure 30:
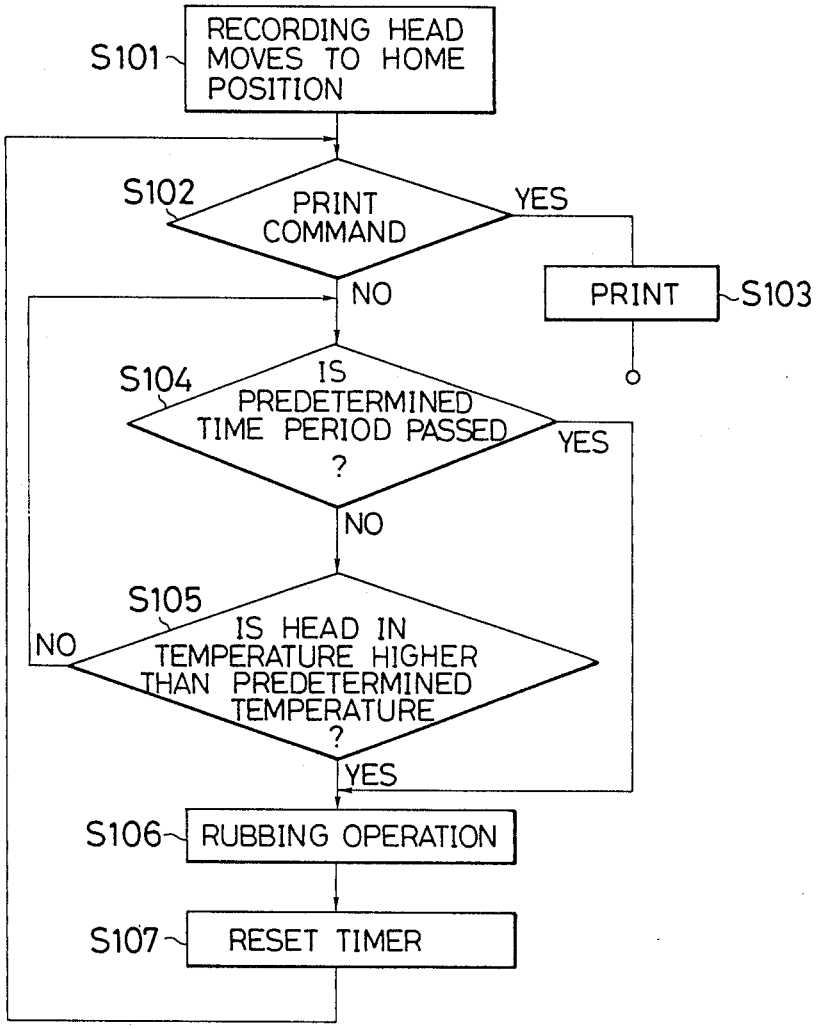
FIG. 30 is a flow chart showing a series of cleaning operation procedures according to the present invention.

FIG. 30 is a flow chart showing the cleaning operation by the present embodiment. At step S101, the recording head 5 stands by at the home position. When at step S102, a recording command is given, the recording head 5 is moved to the recording area and effects recording (step S103). During the recording operation, as in the aforedescribed embodiment, cleaning is effected by the blade 10 for a predetermined time at each recording of a predetermined number of lines. At step S104, the downtime is measured, but even if the downtime does not amount to a predetermined time, when the temperature of the recording head 5 reaches a predetermined value or more (step S105), the discharge port surface is cleaned by the rubbing means to thereby remove the ink film (step S106). Thereafter, at step S107, the timer is reset, and return is made to step S102.

Figure 31:
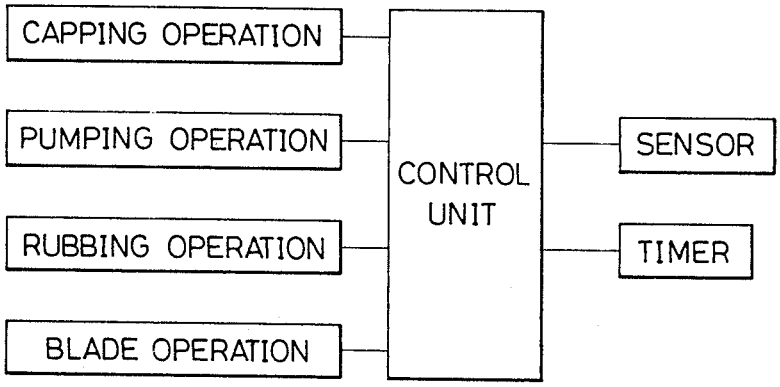
FIG. 31 is a block diagram of the present invention.

FIG. 31 is a block diagram showing the essential portions of a control system according to the present embodiment. As in the aforedescribed embodiments, design may be made such that the rubbing means is moved in operative association with the drive means for effecting capping.

As described above, according to the present embodiment, it becomes possible to effect the cleaning by the rubbing means which corresponds to the period of creation of the ink film, and the discharge port surface can be more efficiently kept in a good condition.

[Tenth Embodiment]

Figure 32:
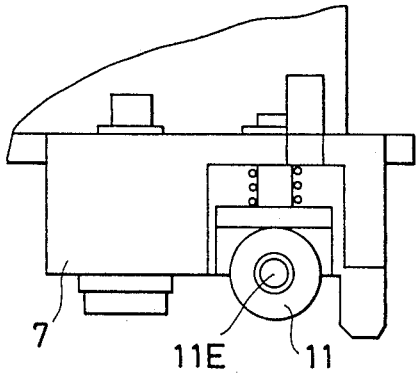
FIG. 32 is a schematic top plan view showing a construction in which a rotatable porous member is made interchangeable.
Figure 33:
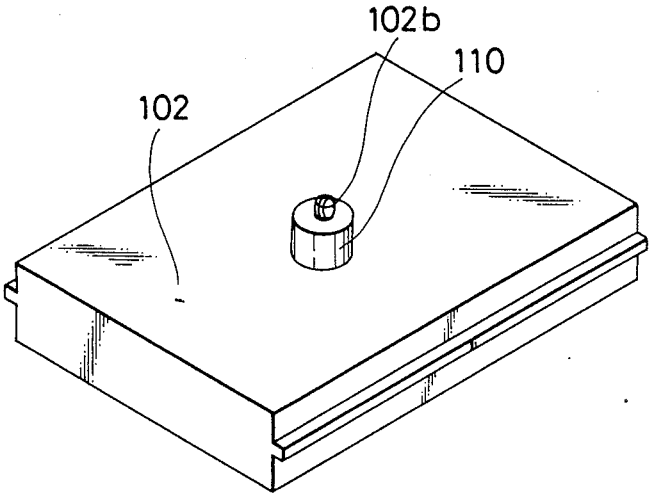
FIG. 33 is a schematic perspective view showing the rotatable porous member shown in FIG. 32 as it is made integral with an ink cartridge.

This embodiment is a construction which corresponds to the aforedescribed fourth embodiment. FIG. 32 shows a construction in which the rotatable porous member 11 is dropped onto the block shaft 11E. Further, in this case, the joint between the rotatable porous member 11 and the ink cartridge 102 is such that as shown in FIG. 33, the rotatable porous member 11 is held on a split pin *102b* provided on the ink cartridge 102. That is, since the rubbing mechanism is also interchanged without fail during the interchange of the ink cartridge, the quality of the porous member is always maintained at a predetermined level or higher, and the occurrence of the non-discharge and the printing misdirection which would otherwise result from the deterioration of the porous member can be completely prevented.

As described above, according to the present invention, the discharge port surface of the recording head is cleaned by effecting the cleaning by the blade and the cleaning comprising rubbing the discharge port surface by the porous member, as the ink recovery operation, and the elimination of the printing misdirection which the shooting point of the ink becomes irregular can be accomplished, and since a series of recovery sequences including the rubbing operation for the recording head are effected, stable discharge can be obtained without requiring any special operation. That is, by the means capable of effectively removing the ink drops, the water drops, the dust, the ink film, etc. adhering to the vicinity of the discharge ports corresponding to the natures thereof, the removing operation can be accomplished correspondingly to the creation of them.

Accordingly, without permitting any foreign material to adhere to the recording head, the ink-repellent property of the surroundings of the discharge ports can be kept good and clean images formed by the ink can be obtained.

We claim:

1. A method of cleaning a surface in which are provided the discharge ports of an ink jet recording apparatus, the method comprising:

wiping the surface using a blade having a certain contact area with the surface; and rubbing the surface using rubbing means having a contact area with the surface larger than the certain contact area independently of said wiping step, wherein said rubbing step is performed less often than said wiping step.

2. A method according to claim 1, wherein said wiping step is effected at plural desired times during a recording operation.

3. A method according to claim 1, wherein said wiping step is effected after each recording of a desired number of lines during a recording operation.

4. A method according to claim 1, wherein said rubbing step is effected after power-ON of the recording apparatus and before recording.

5. A method according to claim 1, wherein the recording apparatus includes temperature detecting means and said rubbing step is effected when the temperature detected by the temperature detecting means reaches at least a desired temperature.

6. A method according to claim 1, wherein repeated said rubbing steps are effected at a time interval greater than repeated said wiping steps.

7. An ink cartridge removably mountable to an ink jet recording apparatus, the cartridge having:

a cleaning member for cleaning a surface in which are provided discharge ports for discharging ink therethrough;

means for containing ink to be supplied to a recording head including the discharge port surface; and means for removably connecting said cleaning member to the cartridge.

8. An ink cartridge according to claim 7, wherein said cleaning member is a rubbing member.

9. An ink cartridge according to claim 7, wherein said cleaning member is a blade.

10. An ink cartridge according to claim 7, wherein said cleaning member is a porous member.

11. An ink cartridge according to claim 7, wherein said cleaning member is an elastic member.

12. An ink cartridge according to claim 7, wherein said cleaning member is connected to the ink cartridge to prevent mounting of the ink cartridge to the ink jet recording apparatus until said cleaning member is removed from the ink cartridge.

13. An ink jet recording apparatus comprising:

a recording head having a surface with discharge ports for discharging ink therethrough;

blade means for wiping said surface and having a certain contact area with said surface;

rubbing means for rubbing said surface and having a contact area with said surface larger than the certain contact area ;and control means for independently wiping said surface with said blade means and rubbing said surface with said rubbing means and for wiping said surface with said blade means more often than said surface is rubbed with said rubbing means.

14. An ink jet recording apparatus according to claim 13, wherein said control means drives said rubbing means in response to a switch and drives said blade means in a predetermined desired sequence.

15. An ink jet recording apparatus according to claim 13, wherein said control means drives said rubbing means when recording downtime exceeds a desired time interval.

16. An ink jet recording apparatus according to claim 13, further having temperature detecting means and wherein said rubbing means is driven when the temperature detected by said temperature detecting means exceeds a desired temperature.

17. An ink jet recording apparatus according to claim 13, further having a cap for covering said discharge ports and wherein said rubbing means is moved with said cap.

18. An ink jet recording apparatus according to claim 13, wherein relative movement of said blade and rubbing means and said recording head effects wiping and rubbing in positions corresponding to the respective positions of said blade means and said rubbing means.

19. An ink jet recording apparatus according to claim 13, wherein said blade means includes an elastic member for bearing against said recording head and said rubbing means includes a porous member for bearing against said recording head.

20. An ink jet recording apparatus according to claim 19, wherein said elastic member is formed of silicone rubber or butyl rubber, and said porous member is formed of at least one of urethane, polyurethane, polyvinyl alcohol, polyethylene, polyvinyl formal and polypropylene.

21. An ink jet recording apparatus according to claim 13, wherein said recording head includes means for forming an image using recording liquid discharged by heat energy that forms droplets of the recording liquid.

22. An ink jet recording apparatus according to claim 13, wherein said recording head has an electro thermal converting member.

23. An ink jet recording apparatus according to claim 13, wherein said recording head has an ink tank for containing ink therein and said recording head is removably mounted to the apparatus.

24. An ink jet recording apparatus according to claim 13, wherein said recording head is a full line type head which is stationary relative to a recording medium and discharges ink for recording on the recording medium.

25. An ink jet recording apparatus according to claim 13, wherein said surface is subjected to an ink-repellent surface treatment.

26. An ink jet recording apparatus according to claim 13, further having heating means for heating a recording medium.

27. An ink jet recording apparatus having a carriage for scanning a recording head having a surface with discharge ports for discharging ink therethrough relative to a recording medium in a recording area and heating means for heating said recording medium, the apparatus comprising:

blade means outside the recording area for wiping said surface in a predetermined sequence during a recording operation;

rubbing means different from said blade means and disposed at a position outside the recording area whereat it can contact said recording head; and moving means for moving said carriage to a position at which said surface can contact said rubbing means, said moving means producing a command for contacting said surface with said rubbing means when a predetermined signal is input to said moving means.

28. An ink jet recording apparatus according to claim 17, wherein the predetermined signal is a signal for driving a recovery device for sucking ink through a cap covering said discharge ports.

29. An ink jet recording apparatus according to claim 27, wherein said moving means moves said carriage relative to said rubbing means.

30. An ink jet recording apparatus according to claim 27, wherein said surface is wiped by said blade means after a predetermined number of lines are recording during a recording operation.

31. An ink jet recording apparatus according to claim 27, wherein said surface is wiped by said blade means when recording is halted after a predetermined time period passes after a recording operation is initiated.

32. An ink jet recording apparatus having a carriage for scanning a recording head having discharge ports for discharging ink therethrough relative to a recording medium in a recording area, the apparatus comprising:

blade means outside the recording area for wiping said discharge ports;

rubbing means different from said blade means and disposed at a position outside the recording area whereas it can contact said recording head;

a drive source for driving a cap of covering said discharge ports and a suction pump communicating with said cap;

first transmitting means for transmitting a driving force from said drive source to move said blade means; and second transmitting means for transmitting a driving force from said drive source to move said rubbing means.

* * * * *

UNITED STATES PATENT AND TRADEMARK OFFICE

CERTIFICATE OF CORRECTION

PATENT NO. : 4,951,066

DATED : August 21, 1990

INVENTOR(S) : KOJI TERASAWA, ET AL.

It is certified that error appears in the above-identified patent and that said Letters Patent is hereby corrected as shown below:

COLUMN 1

Line 8, "thc" should read --the--.
Line 19, "that as in" should be deleted and "(the" should read --(that is, in the--.
Line 33, "4,603,931" should read --4,600,931--.
Line 63, "art," should read --art--.

COLUMN 2

Line 10, "a" should be deleted.
Line 41, "ink film 1D'" should read --ink film ID'--.
Line 55, "to such surface." should read --to adhere to such surface.--.
Line 57, "experiments" should read --experiments,--.

COLUMN 3

Line 16, "a" should read --as--.

COLUMN 4

Line 25, "an ink" (second occurrence) should be deleted.
Line 26, "jet recording apparatus provided" should be deleted.
Line 29, "construction, whereby" should be deleted.
Line 30, Line 30 should be deleted.

UNITED STATES PATENT AND TRADEMARK OFFICE

CERTIFICATE OF CORRECTION

PATENT NO. : 4,951,066

DATED : August 21, 1990

INVENTOR(S) : KOJI TERASAWA, ET AL.

It is certified that error appears in the above-identified patent and that said Letters Patent is hereby corrected as shown below:

COLUMN 8

Line 39, "abovede-" should read --above-de- --.

COLUMN 11

Line 32, "abovede-" should read --above-de- --.

COLUMN 12

Line 52, "lever 20A," should read --lever 20A--.

COLUMN 13

Line 32, "misdirection" should read --misdirections--.
Line 66, "thereare" should read --there are--.

COLUMN 14

Line 14, "direction" should read --directions--.
Line 16, "witch" should read --switch--.

COLUMN 16

Line 26, "which" should read --in which--.

COLUMN 18

Line 45, "17," should read --27,--.
Line 53, "are recording" should read --are recorded--.
Line 68, "whereas" should read --whereat--.

UNITED STATES PATENT AND TRADEMARK OFFICE

CERTIFICATE OF CORRECTION

PATENT NO. : 4,951,066

DATED : August 21, 1990

INVENTOR(S) : KOJI TERASAWA, ET AL.

It is certified that error appears in the above-identified patent and that said Letters Patent is hereby corrected as shown below:

COLUMN 19

Line 1, "of covering" should read --for covering--.

Signed and Sealed this

Seventeenth Day of March, 1992

*Attest:*

HARRY F. MANBECK, JR.

*Attesting Officer*

*Commissioner of Patents and Trademarks*